US010047748B2

(12) United States Patent
Son et al.

(10) Patent No.: US 10,047,748 B2
(45) Date of Patent: Aug. 14, 2018

(54) ROTARY COMPRESSOR, METHOD OF MANUFACTURING A ROTARY COMPRESSOR, AND APPARATUS FOR MANUFACTURING A ROTARY COMPRESSOR

(71) Applicant: LG ELECTRONICS INC., Seoul (KR)

(72) Inventors: Youngboo Son, Seoul (KR); Jonghun Ha, Seoul (KR); Seungmock Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 704 days.

(21) Appl. No.: 14/591,410

(22) Filed: Jan. 7, 2015

(65) Prior Publication Data

US 2015/0192129 A1 Jul. 9, 2015

(30) Foreign Application Priority Data

Jan. 9, 2014 (KR) ..... 10-2014-0002788

(51) Int. Cl.
*F04C 23/00* (2006.01)
*F04C 29/00* (2006.01)
(Continued)

(52) U.S. Cl.
CPC ..... *F04C 23/008* (2013.01); *F04C 11/008* (2013.01); *F04C 18/00* (2013.01);
(Continued)

(58) Field of Classification Search
CPC ..... F04C 23/008; Y10S 417/902
(Continued)

(56) References Cited

U.S. PATENT DOCUMENTS 4,601,644 A * 7/1986 Gannaway ..... F01C 21/007 417/363
6,499,971 B2 * 12/2002 Narney, II ..... F04B 39/023 417/366

(Continued)

FOREIGN PATENT DOCUMENTS

| | | |
|---|---|---|
| CN | 1955482 | 5/2007 |
| EP | 2 628 949 A1 | 8/2013 |
| EP | 2 669 520 A1 | 12/2013 |

OTHER PUBLICATIONS

European Search Report issued in Application No. 15150684.7 dated May 18, 2015.
Chinese Office Action dated Jun. 1, 2016.

*Primary Examiner* — Peter J Bertheaud
(74) *Attorney, Agent, or Firm* — KED & Associates, LLP

(57) ABSTRACT

A rotary compressor, a method of manufacturing a rotary compressor, and an apparatus for manufacturing a rotary compressor are provided. The rotary compressor may include a case having an inner space, a stator to which power may be applied, the stator being disposed in the case, and a compression mechanism disposed on or at one side of the stator to generate a compression force of a refrigerant. The compression mechanism may include a rotational shaft, a cylinder that accommodates a roller coupled to the rotational shaft, a main bearing coupled a first side of the cylinder, and a sub bearing coupled to a second side of the cylinder. The main bearing may be press-fitted and fixed to an inner surface of the case.

12 Claims, 22 Drawing Sheets

(51) Int. Cl.

| | |
|---|---|
| ***F04C 18/02*** | (2006.01) |
| ***F04C 18/08*** | (2006.01) |
| ***F04C 11/00*** | (2006.01) |
| ***F04C 18/00*** | (2006.01) |

(52) U.S. Cl.
CPC ..... *F04C 18/0207* (2013.01); *F04C 18/08* (2013.01); *F04C 29/0042* (2013.01); *F04C 2230/40* (2013.01); *F04C 2230/604* (2013.01); *F04C 2240/50* (2013.01); *Y10S 417/902* (2013.01); *Y10T 29/49245* (2015.01)

(58) Field of Classification Search
USPC ..... 417/410.3, 902
See application file for complete search history.

(56) References Cited

U.S. PATENT DOCUMENTS

| | | | | |
|---|---|---|---|---|
| 7,604,466 | B2 * | 10/2009 | Dreiman | F04C 29/068 181/403 |
| 2008/0019856 | A1 | 1/2008 | Asai | |
| 2013/0309117 | A1 | 11/2013 | Lee et al. | |

* cited by examiner

ROTARY COMPRESSOR, METHOD OF MANUFACTURING A ROTARY COMPRESSOR, AND APPARATUS FOR MANUFACTURING A ROTARY COMPRESSOR

CROSS-REFERENCE TO RELATED APPLICATION(S)

The present application claims priority under 35 U.S.C. 119 and 35 U.S.C. 365 to Korean Patent Applications No. 10-2014-0002788, filed in Korea on Jan. 9, 2014, which is hereby incorporated by reference in its entirety.

BACKGROUND

1. Field

A rotary compressor, a method of manufacturing a rotary compressor, and an apparatus for manufacturing a rotary compressor are disclosed herein.

2. Background

In general, compressors may be mechanical devices that receive power from power generation devices, such as an electric motor or a turbine, to compress air, a refrigerant, or an other working gas, thereby increasing a pressure of the air, refrigerant, or working gas. Compressors are being widely used in home appliances, such as refrigerators and air-conditioners, or whole industrial machinery fields.

Compressors may be largely classified as a reciprocating compressor, in which a compression space into and from which a working gas is suctioned and discharged, is defined between a piston and a cylinder to compress the working gas while the piston is linearly reciprocated within the cylinder; a rotary compressor, in which a compression space into and from which a working gas is suctioned and discharged, is defined between a roller which is eccentrically rotated and a cylinder to compress the working fluid while the roller is eccentrically rotated along an inner wall of the cylinder; and a scroll compressor, in which a compression space into and from which a working gas is suctioned or discharged, is defined between an orbiting scroll and a fixed scroll to compress the working fluid while the orbiting scroll is rotated along the fixed scroll.

FIGS. 1 to 4 are schematic diagrams of a rotary compressor according to a related art. Referring to FIG. 1, the rotary compressor according to the related art may include a case 1*a* that defines an inner space, and a top cover 1*b* coupled to an upper portion of the case 1*a*. A stator 2 that generates a magnetic force using a power source applied thereto, and a compression mechanism 3 that compresses a refrigerant using an induced electromotive force generated by interaction with the stator 2 may be disposed in the case 1*a*.

The compression mechanism 3 may include a rotor 3*a* rotatably disposed inside of the stator 2. The stator 2 and the rotor 3*a* may be understood as components of a compressor motor. Also, the compression mechanism 3 may further include a rotational shaft 4 coupled to the rotor 3*a* to rotate according to rotation of the rotor 3*a*.

The rotary compressor may further include a roller 5 eccentrically coupled to a lower portion of the rotational shaft 4 to rotate with a predetermined eccentric trace according to the rotation of the rotational shaft 4, a cylinder 6, in which the roller 5 may be accommodated, and main and sub bearings 7 and 8, respectively, disposed on upper and lower portions of the cylinder 6 to support the cylinder 6. Each of the main and sub bearings 7 and 8 may have an approximately disc shape to support each of the upper and lower portions of the cylinder 6.

The rotary compressor may further include a vane (not shown) that reciprocates within a slot defined in the cylinder 6 according to the rotation of the roller 5 to separate a suction chamber from a compression chamber, a suction hole 9 and a discharge hole, each of which may define a flow path of the refrigerant that is suctioned into and discharged from the cylinder 6, and a muffler 11 disposed on or at an upper portion of the discharge hole to reduce discharge noise of the refrigerant.

An operation according to the above-described components will be described hereinbelow. When the rotational shaft 4 rotates, the roller 5 may rotate and revolve along an inner circumferential surface of the cylinder 6 while drawing a predetermined eccentric trace. The refrigerant may be introduced into the suction chamber of the cylinder 6 through the suction hole 9. The refrigerant may be compressed in the compression chamber while the roller 5 rotates.

When the compression chamber has an inner pressure higher than a discharge pressure, a discharge valve (not shown) disposed at one side of the discharge hole may be opened, and then the compressed refrigerant may be discharged from the discharge hole through the opened discharge valve. The discharge valve may be disposed in the main bearing 7 disposed on the upper portion of the cylinder 6. The refrigerant discharged through the discharge hole may be introduced into the muffler 11 disposed on an upper portion of the main bearing 7. The muffler 11 may reduce the noise of the discharged refrigerant.

The main bearing 7 may be disposed on the upper portion of the cylinder 6 to disperse a compression force of the refrigerant generated in the cylinder 6 or a force (hereinafter, referred to as a "motor force") generated by the stator 2 and the compression mechanism 3 toward the case 1*a*. Referring to FIGS. 2 and 3, the main bearing 7 may include a plurality of coupling parts or portions W1 coupled to the case 1*a*. Each of the plurality of coupling portions W1 may be understood as a "welding" provided by welding the main bearing 7 to the case 1*a*. The main bearing 7 may have almost a same diameter as or a diameter slightly less than an inner diameter of the case 1*a* so that the main bearing 7 may be coupled to the case 1*a* through the plurality of coupling portions W1.

On the other hand, the sub bearing 8 may be disposed at the lower portion of the cylinder 6 to support the cylinder 6. The sub bearing 8 may have a diameter less than the inner diameter of the case 1*a*. The sub bearing 8 may have an outer circumferential surface that is spaced apart inward from the case 1*a*.

That is, in the rotary compressor according to the related art, as the main bearing 7 has to be coupled to the case 1*a* by welding, the case 1*a* needs to have a predetermined hole for the welding. Thus, the assembling process of the compressor is complicated.

Also, when the welding is defective, the refrigerant may leak, and an imbalance in power between the plurality of coupling portions, that is, weldings, W1 may occur, generating a rotational moment at the cylinder 6 and the main bearing 7 in a predetermined direction. Also, as a predetermined air gap defined between the stator 2 and the rotor 3*a* may be non-uniform, that is, increase or decrease due to the rotational moment, noise from the stator 2 and the compression mechanism 3 may increase. That is, as illustrated in FIG. 4, the air gap $g_1$ may be non-uniform between an inner circumferential surface $l_1$ of the stator 2 and an outer circumferential surface $l_2$ of the rotor 3*a* generating noise.

BRIEF DESCRIPTION OF THE DRAWINGS

Embodiments will be described in detail with reference to the following drawings in which like reference numerals refer to like elements, and wherein.

DETAILED DESCRIPTION

Hereinafter, reference will now be made in detail to embodiments, examples of which are illustrated in the accompanying drawings. The embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 5:
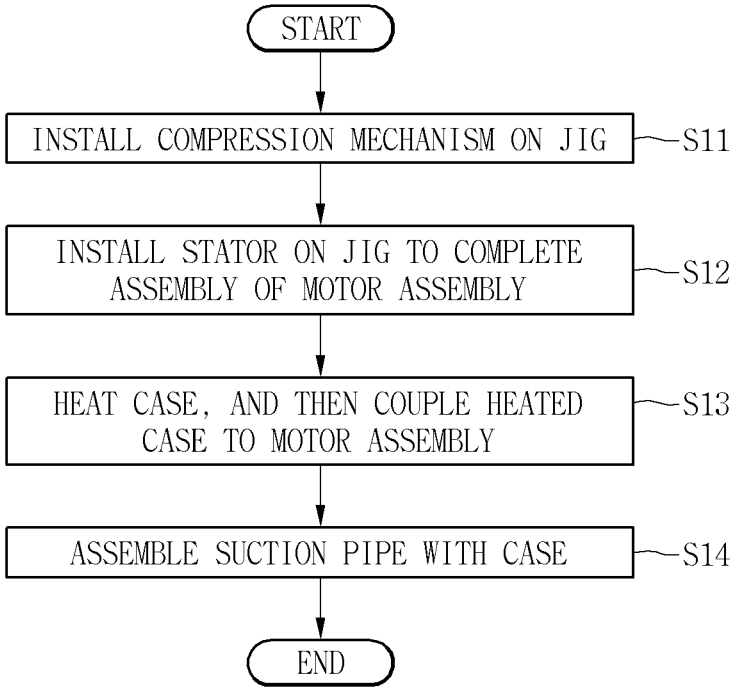
FIG. 5 is a flowchart illustrating a method of manufacturing a rotary compressor according to an embodiment.

FIG. 5 is a flowchart illustrating a method of manufacturing a rotary compressor according to an embodiment. A method of manufacturing a rotary compressor according to an embodiment will be described hereinbelow with reference to FIG. 5.

First, in step S11, a compression mechanism (see reference numeral 100 of FIG. 6) according to an embodiment may be installed onto a jig 200. Then, a stator (see reference numeral 125 of FIG. 9) may be installed on the jig 200, in step S12. The stator 125 may be disposed to surround an outside of a rotor 120 of the compression mechanism 100. When the stator 125 is disposed on the jig 200, a motor assembly including the compression mechanism 100 and the stator 125 may be completely assembled on the jig 200. That is, the motor assembly may be understood as an assembly of the compression mechanism 100 and the stator 125.

A case (see reference numeral 180 of FIG. 10) having an approximately cylindrical shape and an inner space may be heated so that the case is deformable, and then, the motor assembly may be inserted into an inner space of the case 180, in step S13. The stator 125 may have an outer diameter slightly greater than an inner diameter of the case 180. However, the case 180 may be deformed to expand the inner diameter thereof during insertion of the motor assembly.

As the case 180 is cooled, a predetermined portion of the motor assembly may be press-fitted to an inner surface of the case 180 while the case 180 contracts. The predetermined portion may include an outer circumferential surface of the stator 125 and a portion of an outer circumferential surface of the main bearing 130 disposed in the compression mechanism 100. In this way, the motor assembly may be press-fitted into the case 180, and then, in step S14, a suction pipe (see reference numeral 188 of FIG. 11) may be coupled to a connection pipe (see reference numeral 185 of FIG. 11) of the case 180.

Hereinafter, detailed description of components of the above-described compressor and a method of manufacturing the compressor will be described with reference to the accompanying drawings.

Figure 6:
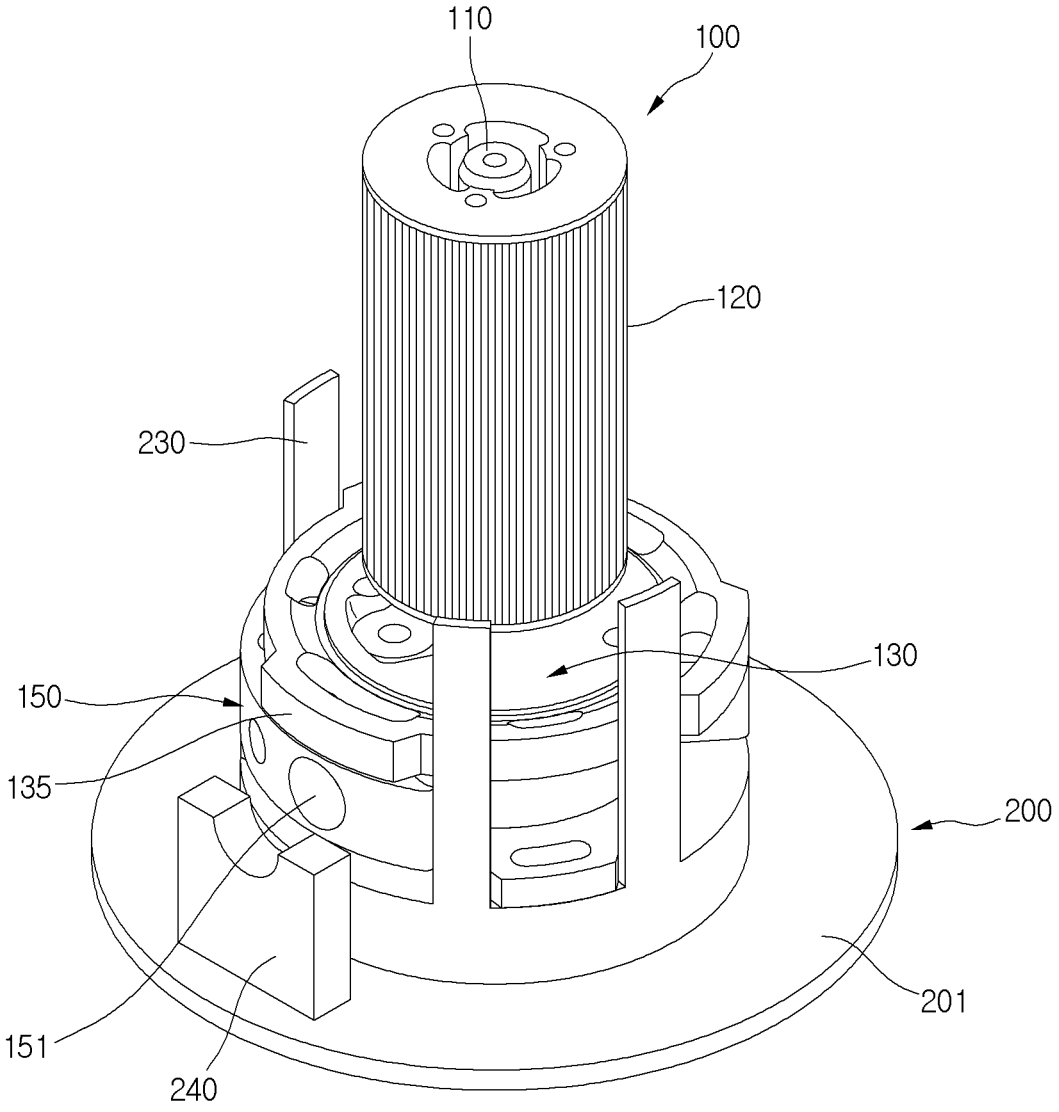
FIGS. 6 and 7 are views illustrating a state in which a compression mechanism is disposed on a jig according to an embodiment.
Figure 7:
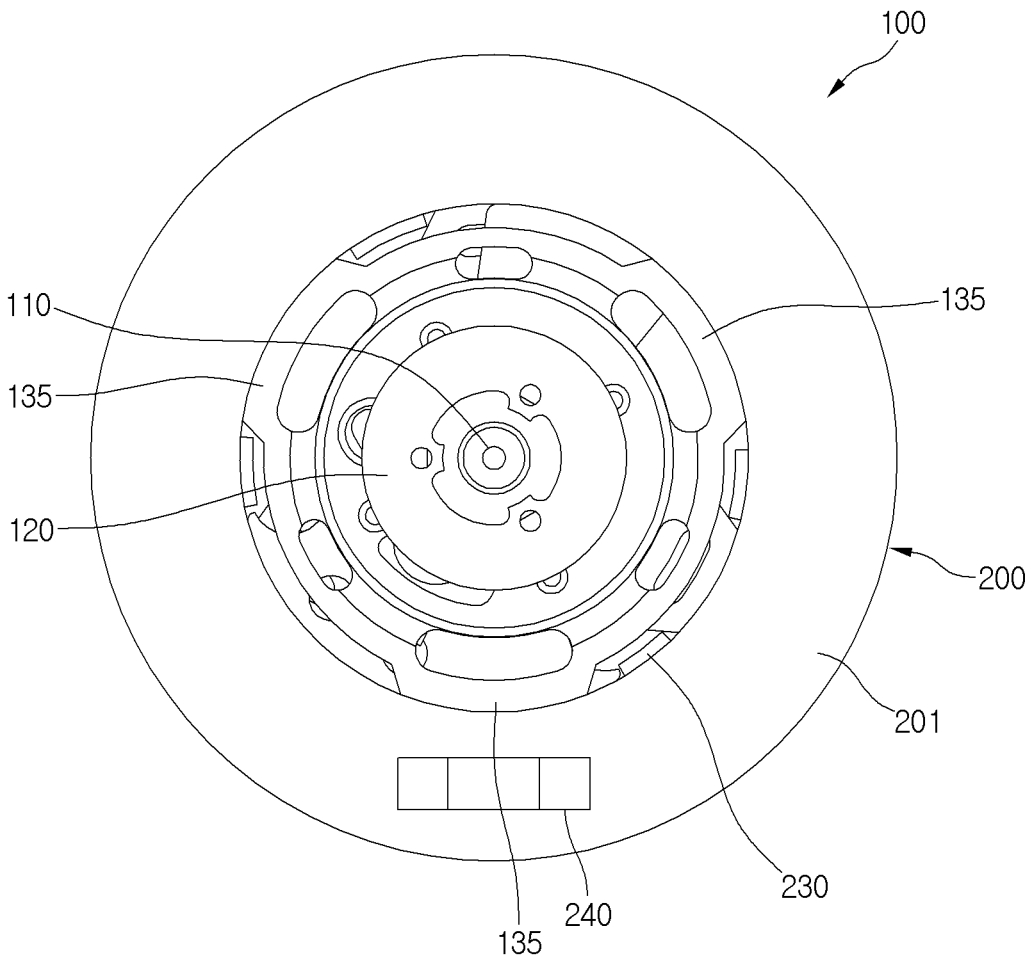
Figure 8:
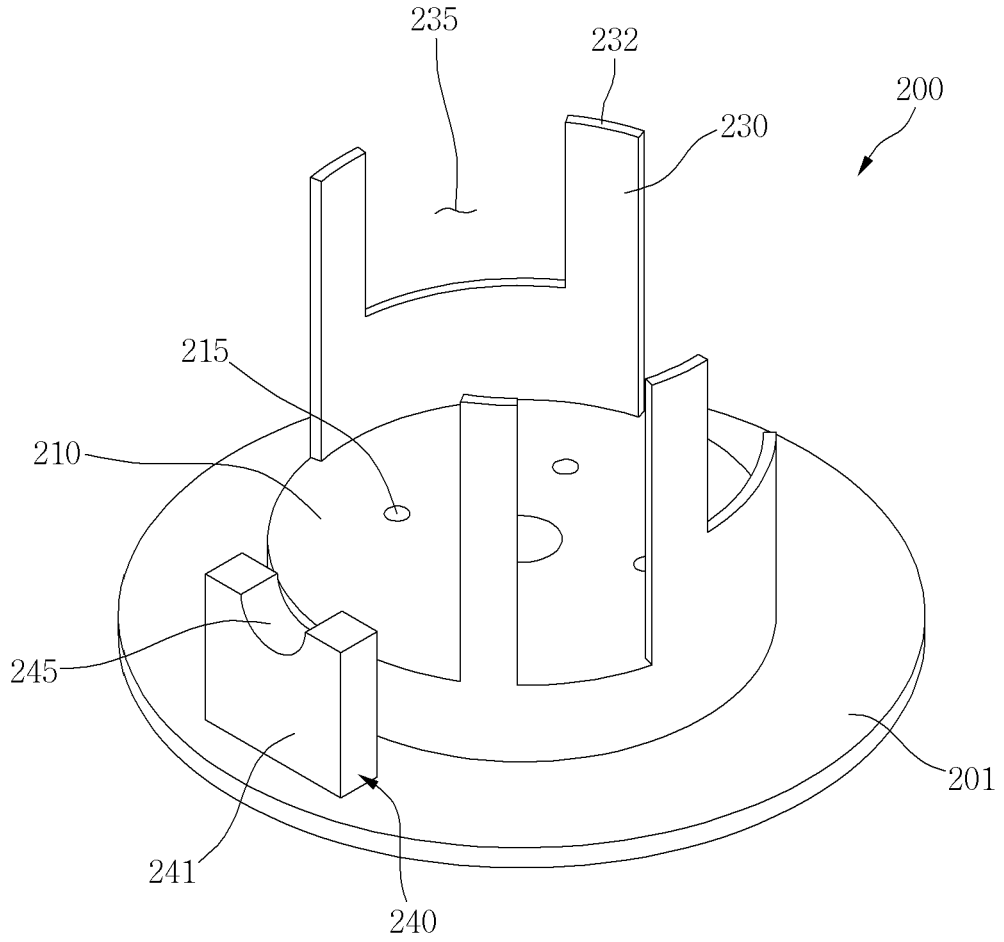
FIG. 8 is a view of the jig according to an embodiment.

FIGS. 6 and 7 are views illustrating a state in which a compression mechanism is disposed on a jig according to an embodiment. FIG. 8 is a view of the jig according to an embodiment.

Referring to FIGS. 6 to 8, the compression mechanism 100 according to an embodiment may include a rotational shaft 110, which may be rotatable. The rotational shaft 110 may be rotated by a rotational force generated by an electric mechanism. The electric mechanism may include the stator (see reference numeral 125 of FIG. 9), which may generate a magnetic force, and the rotor 120 disposed at one side of or adjacent to the stator 125 to rotate by interacting with the stator 125. The rotational shaft 110 may be coupled to the rotor 120.

The compression mechanism 100 may include a roller (not shown) eccentrically coupled to the rotational shaft 110 to rotate according to a predetermined rotational radius, a cylinder 150 that accommodates the roller and defines a suction chamber and a compression chamber for a refrigerant, a main bearing 130 coupled to an upper portion of the cylinder 150, and a sub bearing 160 coupled to a lower portion of the cylinder 150. A suction hole 151, into which the refrigerant may be suctioned, may be defined in the cylinder 150.

The rotational shaft 110 may pass through the main bearing 130 to extend to the roller. The main bearing 130 and the roller may be coupled to the rotational shaft 110 to surround the rotational shaft 110.

The main bearing 130 may be disposed on the upper portion of the cylinder 150 to disperse a force generated while the compressor mechanism 100 operates and to absorb vibration generated while the compressor mechanism 100 operates. Thus, the main bearing 130 may include one or more press-fit portion 135 press-fitted to an inner circumferential surface of the case 180. The press-fit portion 135 may define at least a portion of an outer circumferential surface of the main bearing 130. The rotational shaft 110 may be disposed to pass through the main bearing 130.

The sub bearing 160 may be disposed on or at a lower portion of the cylinder 150. The rotational shaft 110 may be disposed to pass through the sub bearing 160.

The compressor mechanism 100 may be disposed on the jig 200. In detail, the jig 200 may include a base 201 that defines a lower portion of the jig 200 and a seat 210 that protrudes in an upward direction from the base 201 to allow the compression mechanism 100 to be seated thereon.

The base 201 may have a disc shape, slightly larger than a diameter of the case 180, and may be stably placed on the ground during the process for manufacturing the compressor. The seat 210 may include a seat surface on which a portion of the compression mechanism 100, that is, the sub bearing 160 may be placed.

The seating surface may define a top surface of the seat 210. The seat surface may include one or more bearing fixing portion 215 to fix the sub bearing 160. A coupling member may be coupled to the bearing fixing portion 215 to fix the seat 210 and the sub bearing 160 to each other.

The jig 200 may include one or more stator support 230 that extends in the upward direction from the seat 210. The stator support 230 may support the stator 125 to be disposed on the jig 200 to guide an installation position of the stator 125. The stator support 230 may include a support surface 232, on which a portion of an outer circumferential surface of the stator 125 may be seated. The support surface 232 may define a top surface of the stator support 230.

The one or more stator support 230 may include a plurality of the stator supports 230, and the plurality of the stator supports 230 may be spaced apart from each other. A placing portion 235, on which the press-fit portion 135 of the main bearing 130 may be placed, may be defined between a first portion of the plurality of stator supports 230 and a second portion of the plurality of stator supports 230. The placing portion 235 may be understood as a space between two stator supports 230 which protrude in the upward direction.

When the compression mechanism 100 is disposed on the jig 200, a coupling direction of the compression mechanism 100 may be guided so that the press-fit portion 135 of the main bearing 130 may be placed on the placing portion 235. That is, the stator support 230 may guide the installation position of the compression mechanism 100.

When the press-fit portion 135 is adjusted in position and placed on the placing portion 235, and the compression mechanism 100 is disposed in position on the jig 200, the suction hole 151 of the cylinder 150 may be disposed to face a pipe aligning portion 245 of a guide 240, which will be described hereinbelow. The suction hole 151 of the cylinder 150 may communicate with the connection pipe 185, which will be described hereinbelow, and be coupled to suction pipe 188.

The jig 200 may further include the guide 240, on which the connection pipe 185 disposed on the case 180 may be placed when the case is coupled to the jig 200. The guide 240 may extend in the upward direction from the base 201 and be disposed spaced apart outward from the seat 210 with respect to a center of the jig 200.

The guide 240 may include a main body 241 having an approximately plate shape, and the pipe aligning portion 245 recessed in a downward direction from a top surface of the main body 241 to allow the connection pipe 185 to be seated thereon. When the case 180 is coupled to the motor assembly, the case 180 or the motor assembly may be guided in a direction in which the connection pipe 185 of the case 180 is placed on the pipe aligning portion 245.

Figure 9:
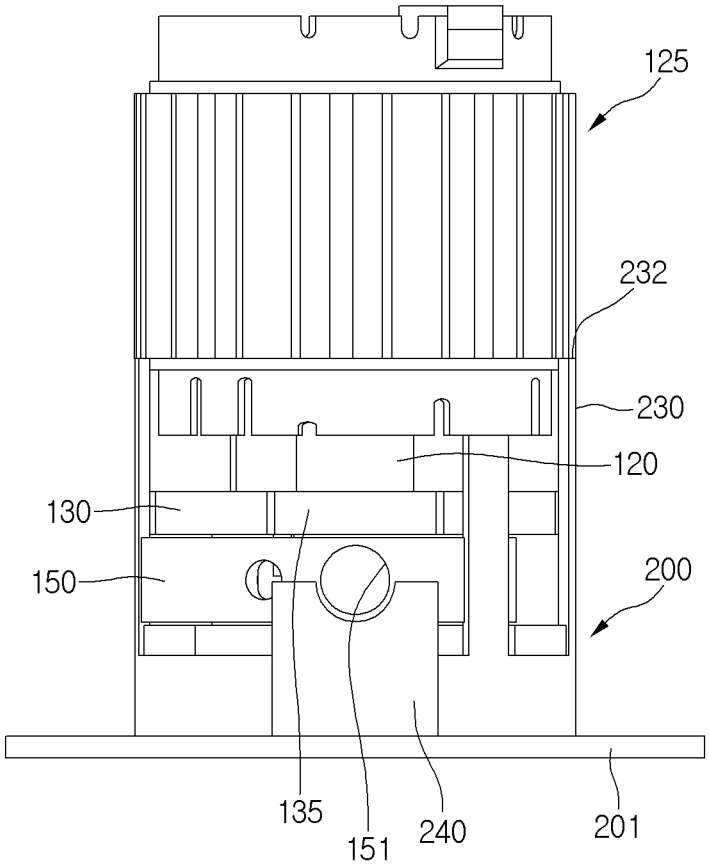
FIG. 9 is a view illustrating a state in which a stator and the compression mechanism are disposed on the jig according to an embodiment.
Figure 10:
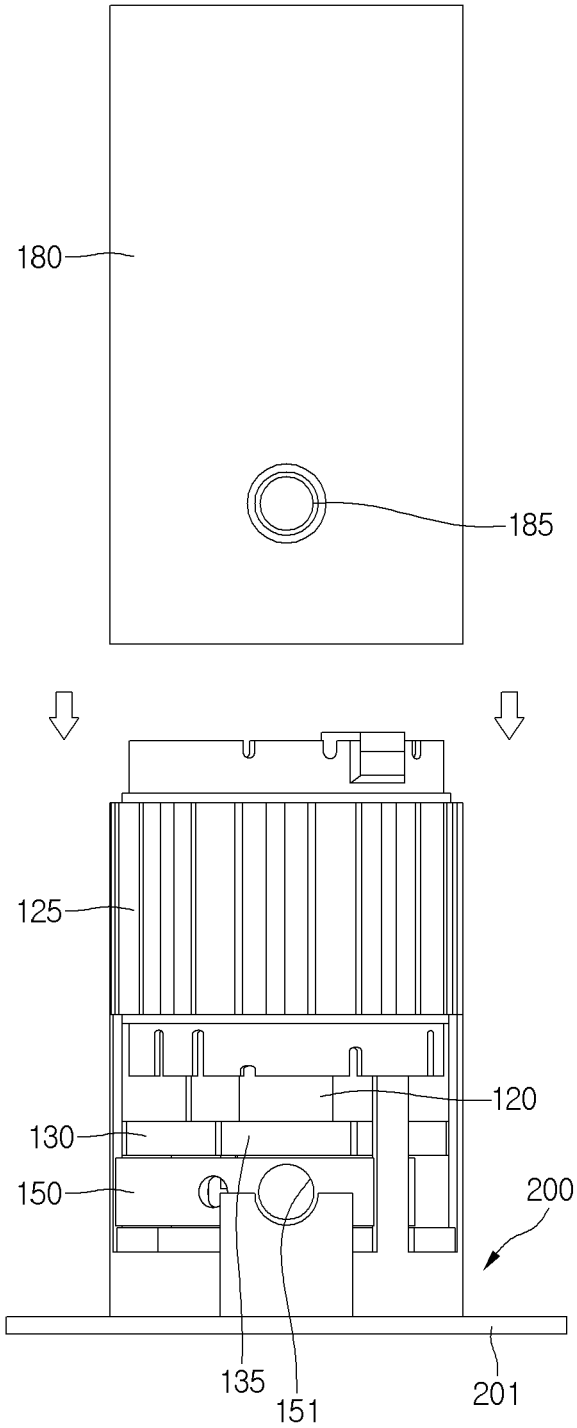
FIG. 10 is a view illustrating a state in which the stator and the compression mechanism are inserted into a heated case according to an embodiment.
Figure 11:
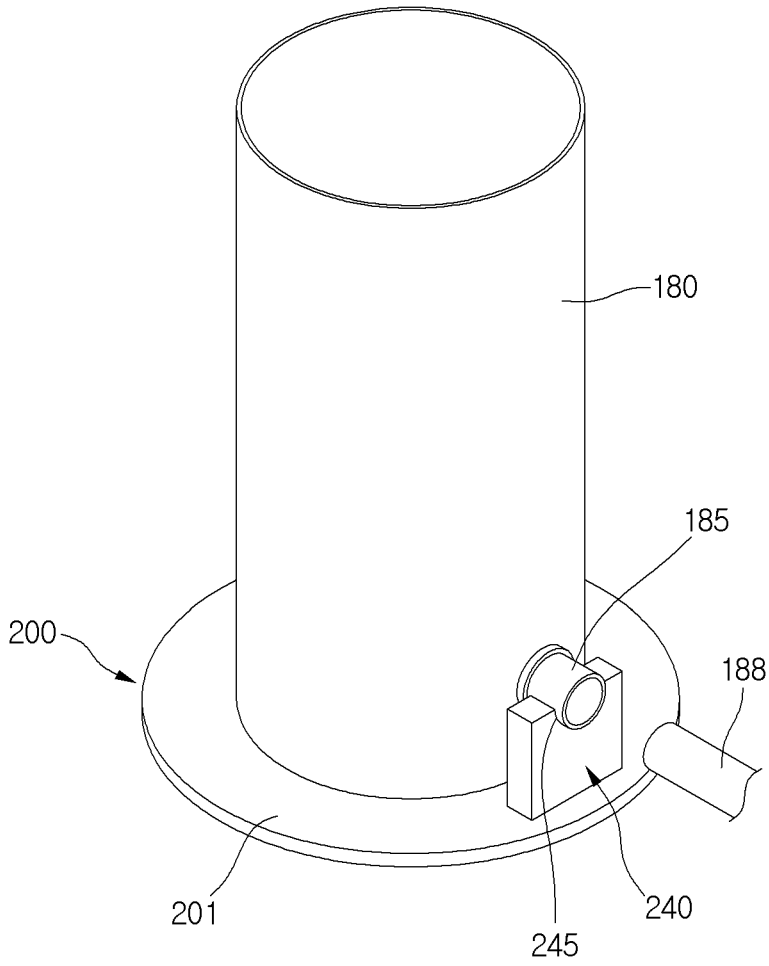
FIG. 11 is a view illustrating a state in which a suction pipe is coupled to the case according to an embodiment.

FIG. 9 is a view illustrating a state in which a stator and the compression mechanism are disposed on the jig according to an embodiment. FIG. 10 is a view illustrating a state in which the stator and the compression mechanism are inserted into a heated case according to an embodiment. FIG. 11 is a view illustrating a state in which a suction pipe is coupled to the case according to an embodiment.

A method of manufacturing the rotary compressor will be described with reference to FIGS. 9 to 11.

Referring to FIGS. 9 and 10, the stator 125 may be disposed at the outside of the rotor 120 in a state in which the compression mechanism 100 is disposed on the jig 200. The stator 125 may be supported by the plurality of stator supports 230. In detail, when the stator 125 is installed, a portion of the outer circumferential surface of the stator 125 may be seated on the support surface 232 of each of the plurality of stator supports 230. The case 180 may be heated after the stator 125 is completely installed. The connection pipe 185 that communicates with the suction hole 151 of the cylinder 150 may be previously coupled to a lower side of an outer circumferential surface of the case 180. At least a portion of the case 180, in particular, an area of the case 180 that is coupled to the press-fit portion 135 of the main bearing 130 and the outer circumferential surface of the stator 125 may be heated so that the case 180 is easily deformed.

When the case 180 is heated, the case 180 may be moved toward the jig 200 and coupled to the outside of the motor assembly. That is, the motor assembly may be inserted into the case 180. The case 180 may be moved until the connection pipe 185 is placed on the pipe aligning portion 245 of the guide 240. In this way, the guide 240 may be provided to easily guide the coupling position of the case 180.

The case 180 may be cooled after the case 180 is coupled to the motor assembly. A cooling method may include natural cooling or forced cooling. When cooling is completed, a portion of an outer surface of the motor assembly may be stably fixed to the inner circumferential surface of the case 180 while an inner diameter of the case 180 is contracted.

When the case 180 is completely coupled to the motor assembly, the connection pipe 185 of the case 180 may be coupled to the suction pipe 188. The suction pipe 188 may be a pipe through which the refrigerant may be suctioned in from a gas-liquid separator (not shown) to the rotary compressor. In detail, in a state in which the connection pipe 185 is supported by the pipe aligning portion 245, the suction pipe 188 may be inserted into the connection pipe 185 and coupled to the suction hole 151 of the cylinder 150.

Figure 1:
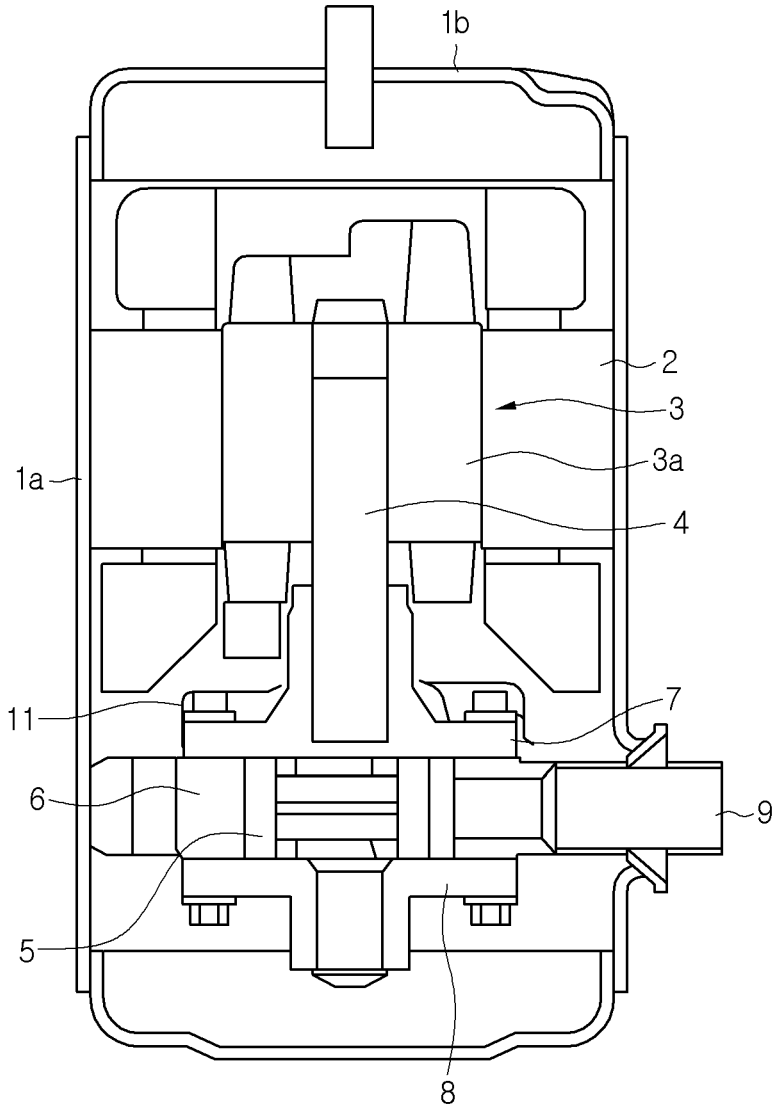
FIG. 1 is a schematic diagram of a rotary compressor according to a related art.
Figure 2:
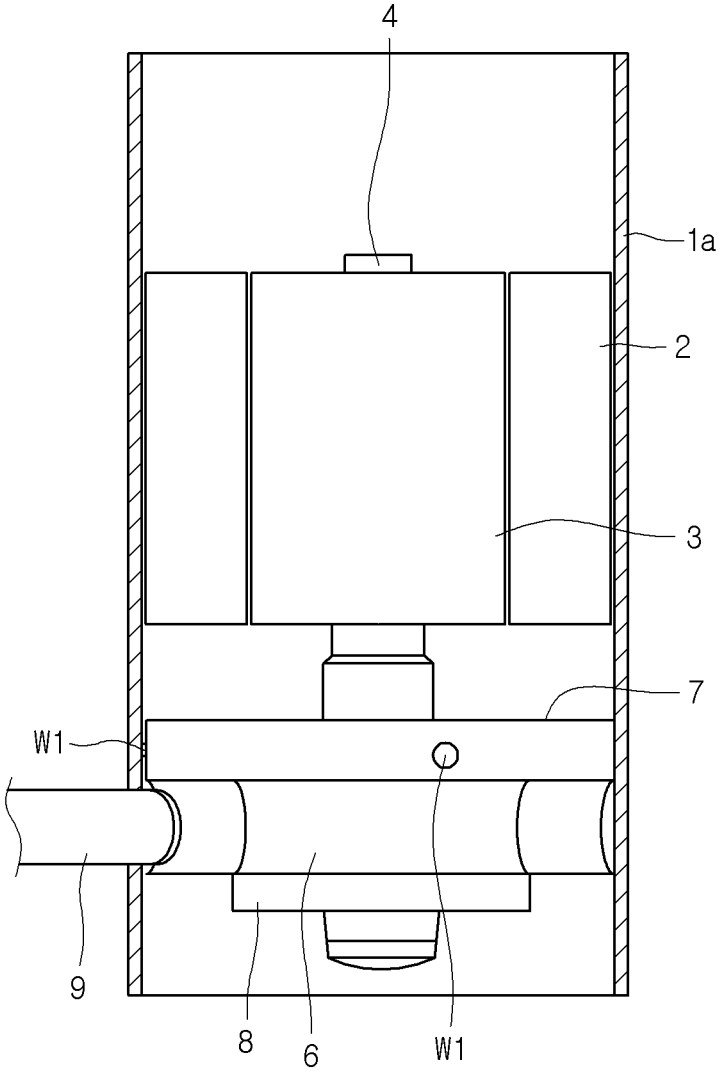
FIG. 2 is a schematic diagram illustrating internal components of the related rotary compressor of FIG. 1.
Figure 3:
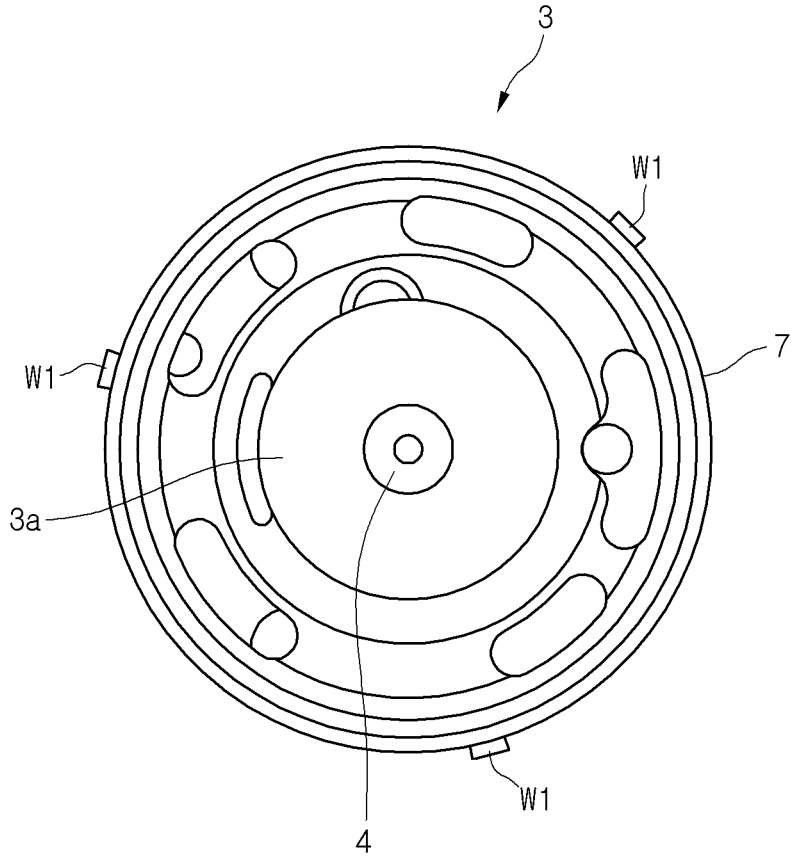
FIG. 3 is a schematic diagram illustrating a compression mechanism of the related art rotary compressor of FIG. 1.
Figure 12:
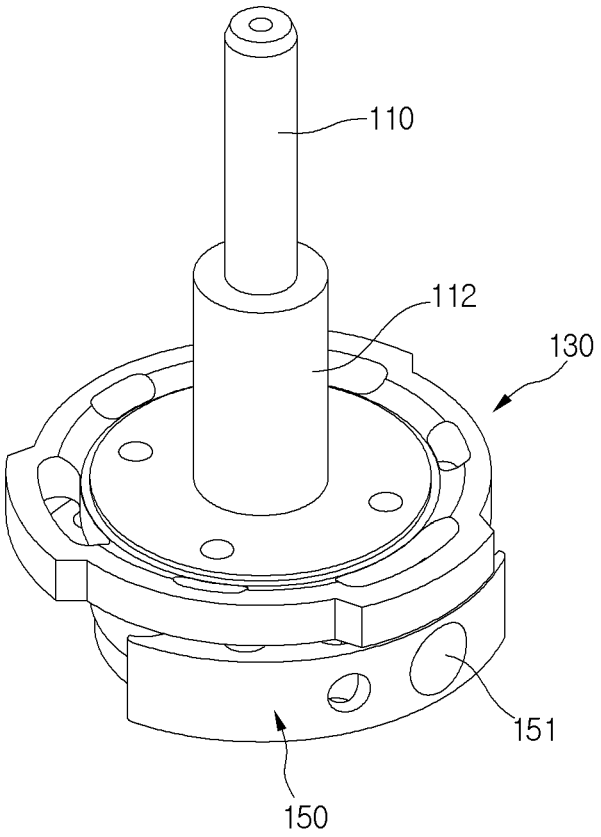
FIG. 12 is a perspective view of a cylinder assembly according to an embodiment.
Figure 13:
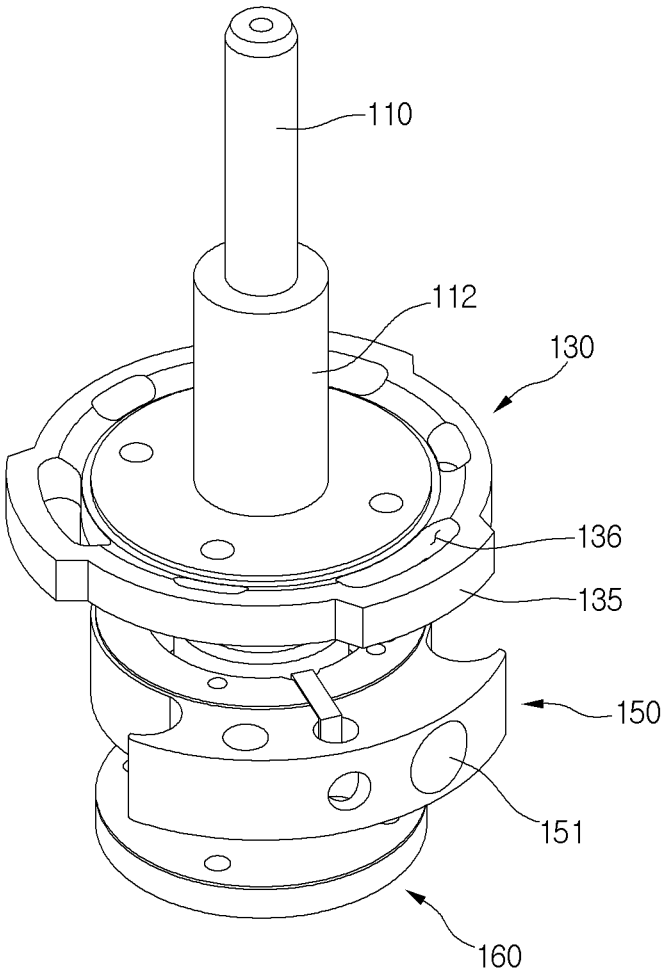
FIG. 13 is an exploded perspective view of the cylinder assembly of FIG. 12.
Figure 14:
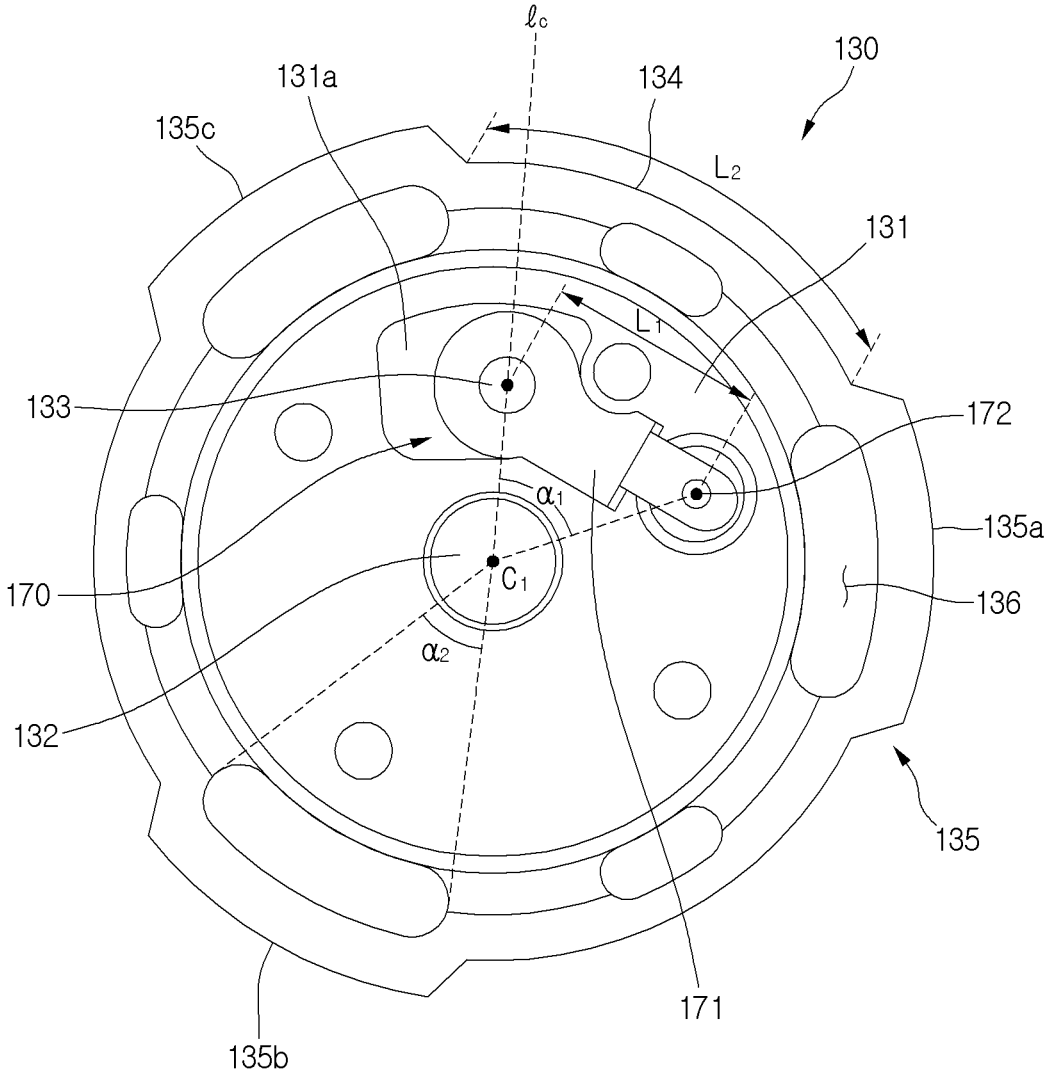
FIG. 14 is a view of a main bearing according to an embodiment.

FIG. 12 is a perspective view of a cylinder assembly according to an embodiment. FIG. 13 is an exploded perspective view of the cylinder assembly of FIG. 1. FIG. 14 is a view of a main bearing according to an embodiment.

A portion of components of the compression mechanism 100 according to an embodiment will be described with reference to FIGS. 12 to 14.

The compression mechanism 100 according to an embodiment may include the cylinder 150 eccentrically coupled to the rotational shaft 110 to accommodate the roller rotating according to the predetermined rotational radius and defining the suction chamber and the compression chamber of the refrigerant, the main bearing 130 coupled to the upper portion of the cylinder 150, and the sub bearing 160 coupled to the lower portion of the cylinder 150. A shaft housing 112 that surrounds at least a portion of the rotational shaft 110 may be disposed on the upper portion of the main bearing 130. The shaft housing 112 may extend in the upward direction from a top surface of the main bearing 130.

The main bearing 130 may be designed in shape or dimension (hereinafter, referred to as "designed in dimension") to withstand load or vibration applied to the compression mechanism 100 due to a motor electromagnetic force or a refrigerant gas discharge force generated while the compressor operates and prevent the compression mechanism 100 from being deformed while the compression mechanism 100 is inserted into the case 180. In detail, the main bearing 130 may include a bearing body 131 having an approximately disc shape, and a shaft through hole 132, through which the rotational shaft 110 may pass, and a discharge valve 170 openably disposed on the bearing body 131.

A valve installation portion 131*a*, on which the discharge valve 170 may be seated, may be disposed on the bearing body 131. The valve installation portion 131*a* may have a shape which in a recessed in a downward direction from a top surface of the bearing body 131. A discharge hole 133, through which the refrigerant compressed by the cylinder 150 may be discharged, may be defined in the recessed portion of the valve installation portion 131*a*.

The discharge valve 170 may move to selectively open the discharge hole 133. The discharge valve 170 may include a valve body 171 disposed on the valve installation portion 131*a* to cover an upper side of the discharge hole 133, and a coupling portion 172 disposed on or at one side of the valve body 171 to allow the valve body 171 to be coupled to the bearing body 131.

The valve body 171 may move in a upward or downward direction with respect to the coupling portion 172. When the refrigerant compressed in the cylinder 150 has a pressure greater than a predetermined pressure, the valve body 171 may open the discharge hole 133 while moving upward. When the refrigerant has a pressure less than the predetermined pressure, the valve body 171 may cover the discharge hole 133 while moving downward.

The main bearing 130 may include at least one press-fit portion 135 that extends toward the outside of the bearing body 131 in a radial direction and press-fitted to the inner circumferential surface of the case 180, and a non-contact portion 134, which is not press-fitted to the inner circumferential surface of the case 180, that is, which is spaced apart from the inner circumferential surface of the case 180.

The press-fit portion 135 and the non-contact portion 134 may define the outer circumferential surface of the main bearing 130. Also, one or more press-fit portion 135 and one or more non-contact portion 134 may be provided. For example, a plurality of press-fit portions 135*a*, 135*b*, and 135*c* may be provided. The plurality of press-fit portions 135*a*, 135*b*, and 135*c* may be disposed spaced apart from each other along the outer circumferential surface of the main bearing 130.

The plurality of press-fit portions 135*a*, 135*b*, and 135*c* may include a first press-fit portion 135*a*, a second press-fit portion 135*b*, and a third press-fit portion 135*c*. In this embodiment, although three press-fit portions are shown; embodiments are not limited thereto. That is, two or four or more press-fit portions may be provided. However, the plurality of press-fit portions may be spaced apart from each other at a same interval. That is, as a portion of the outer circumferential surface of the main bearing 130 is press-fitted to the inner circumferential surface of the case 180 by the plurality of press-fit portions, deformation due to the press-fit may be reduced.

The valve installation portion 131*a* may be recessed. Thus, the main bearing 130 may have a relatively thin thickness at a portion at which the valve installation portion 131*a* is formed in comparison to other portions thereof. If the valve installation portion 131*a* is too deeply recessed, discharge of the compressed refrigerant may be restricted. Thus, the refrigerant may be expanded into the cylinder. Thus, the valve installation portion 131*a* may have a depth less than a predetermined depth.

Similarly, as the valve installation portion 131*a* has a shallow depth, the press-fit portion 135 may be disposed on only a portion of the outer circumferential surface of the main bearing 130, but may not be disposed on the entire outer circumferential surface of the main bearing 130 to prevent the valve installation portion 131*a* from being deformed or damaged. A ratio of the area on which the press-fit portions are disposed to the entire outer circumferential surface of the main bearing 130 will be described with reference to FIG. 22.

The main bearing 130 may include a deformation prevention portion 136 to prevent the main bearing 130 or the compression mechanism 100 from being deformed due to contraction when the press-fit portion 135 is press-fitted to the inner surface of the case 180. The deformation prevention portion 136 may be defined to vertically pass through at least a portion of the main bearing 130.

The deformation prevention portion 136 may be defined inside of the press-fit portion 135 in a radial direction. For example, when a plurality of the press-fit portion 135 is provided, the deformation prevention portion 136 may be defined inside of each of the plurality of press-fit portions 135*a*, 135*b*, and 135*c* in the radial direction. In other words, the deformation prevention portion 136 may have a cut shape defined between the outer circumferential surface of the bearing body 131 and the plurality of press-fit portions 135*a*, 135*b*, and 135*c*. As the deformation prevention portion 136 is vertically defined in the main bearing 130 to provide a space in which a compressed discharge gas or oil may flow, the deformation prevention portion 136 may be referred to as an "oil hole".

Other portions of the outer circumferential surface of the main bearing 130, except for portions of the outer circumferential surface of the main bearing 130 on which the plurality of press-fit portions 135*a*, 135*b*, and 135*c* is defined, may be defined as the non-contact portion(s) 134, which is not in contact with the inner circumferential surface of the case 180. As the plurality of press-fit portions 135*a*, 135*b*, and 135*c* is spaced apart from each other, the non-contact portion(s) 134 may be defined between the plurality of press-fit portions spaced apart from each other.

A virtual line lc that connects a central portion or center of the main bearing 130, that is, a central portion or center $C_1$ of the shaft through hole 132 to a central portion or center of the discharge hole 133 may be defined to contact the non-contact portion 134. That is, to reduce deformation in the discharge hole 133 while the main bearing 130 is press-fitted, the virtual line lc may be defined on the non-contact portion 134, and may not be defined on the press-fit portion 135.

Also, an angle $\alpha_2$ formed by lines that connects the central portion or center $C_1$ of the main bearing 130 to both end portions of the deformation prevention portion 136 may be greater than an angle $\alpha_1$ formed by lines that connects the central portion $C_1$ of the main bearing 130 to both side portions of the valve installation portion 131*a* (when the deformation prevention portion 136 is designed in dimension).

The both side portions of the valve installation portion 131*a* may be understood as the central portion of the discharge hole 133 and a central portion of the coupling portion 172. Also, when a plurality of the deformation prevention portion 136 is provided, the angle $\alpha_2$ may be understood as the total angle obtained by adding angles formed depending on sizes of the plurality of deformation prevention portions 136. According to this structure, the deformation prevention portion 136 may have a size greater than a size of the valve installation portion 131*a* to prevent the compression mechanism 100 from being deformed.

The non-contact portion 134 may have a length $L_2$ that is longer than a length $L_1$ of a line that connects a central portion or center of both side portions of the valve installation portion 131*a* to each other (when the non-contact portion is designed in dimension). Also, when a plurality of the non-contact portion 134 is provided, the length $L_2$ may be understood as a total length obtained by adding lengths formed depending on sizes of the plurality of non-contact portions 134. According to this structure, the non-contact portion 134, which is not press-fitted, may have a length greater than a length of the valve installation portion 131*a* to prevent the compression mechanism 100 from being deformed.

Briefly, when the main bearing 130 according to this embodiment is designed, at least one of the deformation prevention portion or the non-contact portion may be designed in dimension.

Hereinafter, a main bearing according to another embodiment will be described. In this embodiment, elements different from those described above with reference to FIG. 14 will be described, like reference numerals have been used to indicate like elements, and repetitive disclosure has been omitted.

Figure 15:
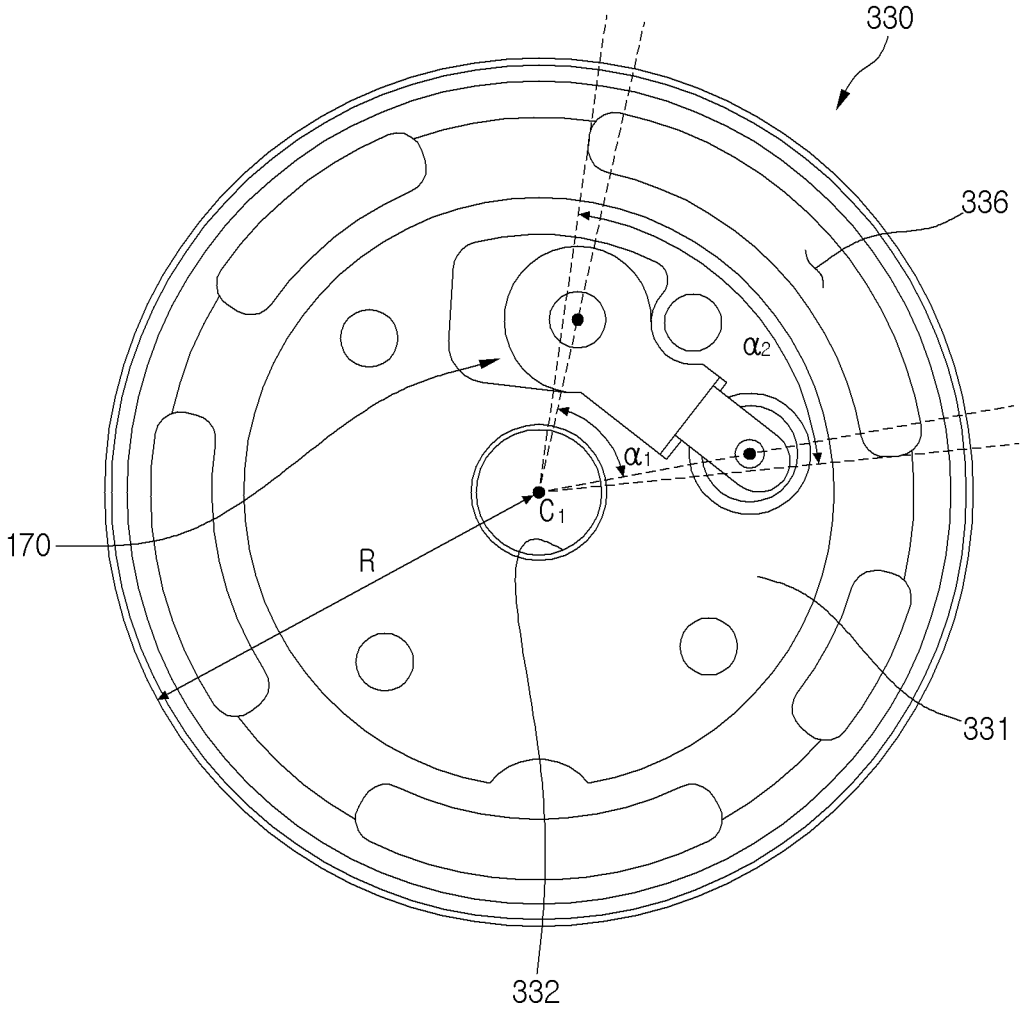
FIG. 15 is a view of a main bearing according to another embodiment.

FIG. 15 is a view of a main bearing according to another embodiment. Referring to FIG. 15, a main bearing 330 according to this embodiment may include a deformation prevention portion 336 to prevent the compression mechanism 100 from being deformed when the compression mechanism 100 is press-fitted into the case.

In detail, an entire outer circumferential surface of the main bearing 330 may be press-fitted to the inner surface of the case 180. That is, the entire outer circumferential surface of the main bearing 330 may be defined as a press-fit portion.

The main bearing 330 may include a bearing body 331 having an approximately disc shape and a shaft through hole 332, into which the rotational shaft 110 may be inserted, and the deformation prevention portion 336 cut along a circumference of the bearing body 331. As the deformation prevention portion 336 is vertically defined in the main bearing 330 to provide a space in which a compressed discharge gas or oil may flow, the deformation prevention portion 336 may be referred to as an "oil hole". Also, a plurality of the deformation prevention portion 336 may be provided.

An angle $\alpha_2$ formed by lines that connects central portion $C_1$ of the main bearing 330 to both end portions of the deformation prevention portion 336 may be greater than an angle $\alpha_1$ formed by lines that connects the central portion $C_1$ of the main bearing 330 to both side portions of the valve installation portion (see reference numeral 131*a* of FIG. 14) (when the deformation prevention portion 336 is designed in dimension). The both side portions of the valve installation portion 131*a* may be understood as the central portion of the discharge hole 133 and the central portion of the coupling portion 172. Also, when a plurality of the deformation prevention portion 336 is provided, the angle $\alpha_2$ may be understood as the total angle obtained by adding angles formed depending on sizes of the plurality of deformation prevention portions 336.

According to this structure, the deformation prevention portion 336 may have a size greater than a size of the valve installation portion 131*a* to prevent the compression mechanism 100 from being deformed.

Figure 16:
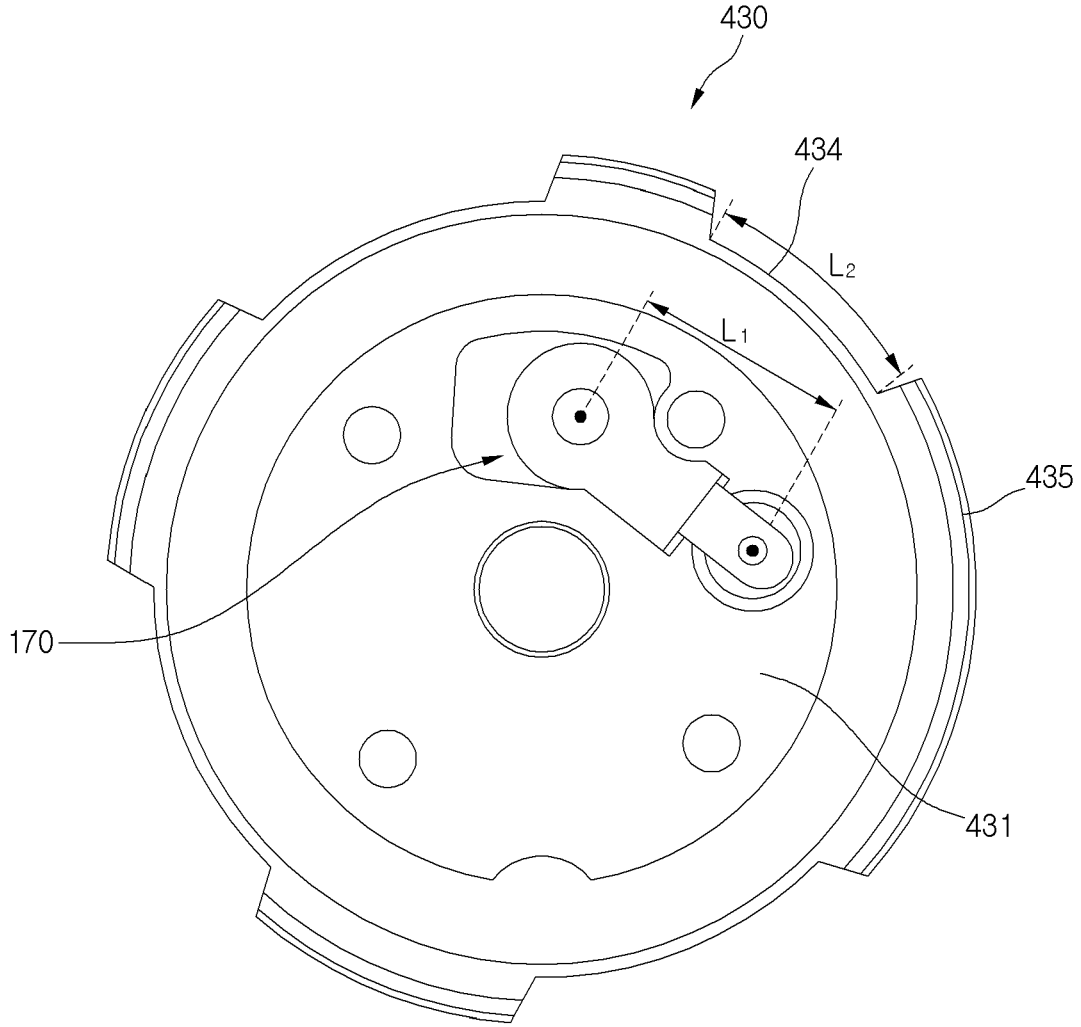
FIG. 16 is a view of a main bearing according to a further embodiment.

FIG. 16 is a view of a main bearing according to a further embodiment. Referring to FIG. 16, a main bearing 430 according to this embodiment may include a bearing body 431 having an approximately disc shape, press-fit portion 435 that defines an outer circumferential surface of the bearing body 431, and a non-contact portion 434. The press-fit portion 435 may be press-fitted to the inner circumferential surface of the case 180, and the non-contact portion 434 may not be press-fitted to or contact the inner circumferential surface of the case 180. Also, a plurality of the press-fit portion 435 and a plurality of the non-contact portion 434 may be provided. When a plurality of each of the press-fit portion 435 and the non-contact portion 434 is provided, one non-contact portion 434 may be disposed between two press-fit portions 435.

The non-contact portion 434 may have a length $L_2$ that is longer than a length $L_1$ of a line that connects both side portions of the valve installation portion (see reference numeral 131*a* of FIG. 14) to each other (when the non-contact portion 434 is designed in dimension). When a plurality of the non-contact portion 434 is provided, the length $L_2$ may be understood as a total length obtained by adding lengths formed depending on sizes of the plurality of non-contact portions 434.

According to this structure, the non-contact portion 434, which is not press-fitted, may have a length greater than a length of the valve installation portion 131*a* to prevent the compression mechanism 100 from being deformed.

Figure 17:
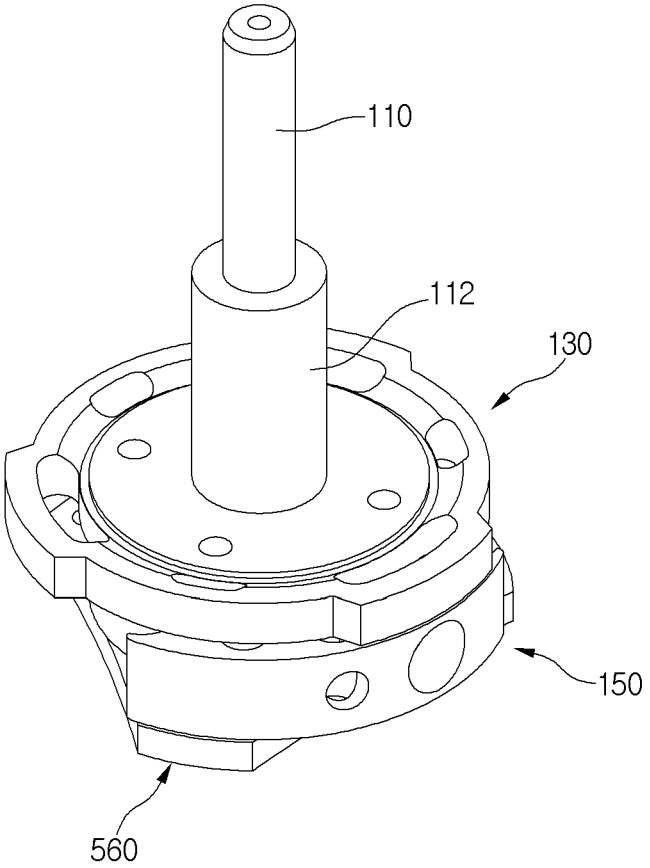
FIG. 17 is a perspective view of a cylinder assembly according to another embodiment.
Figure 18:
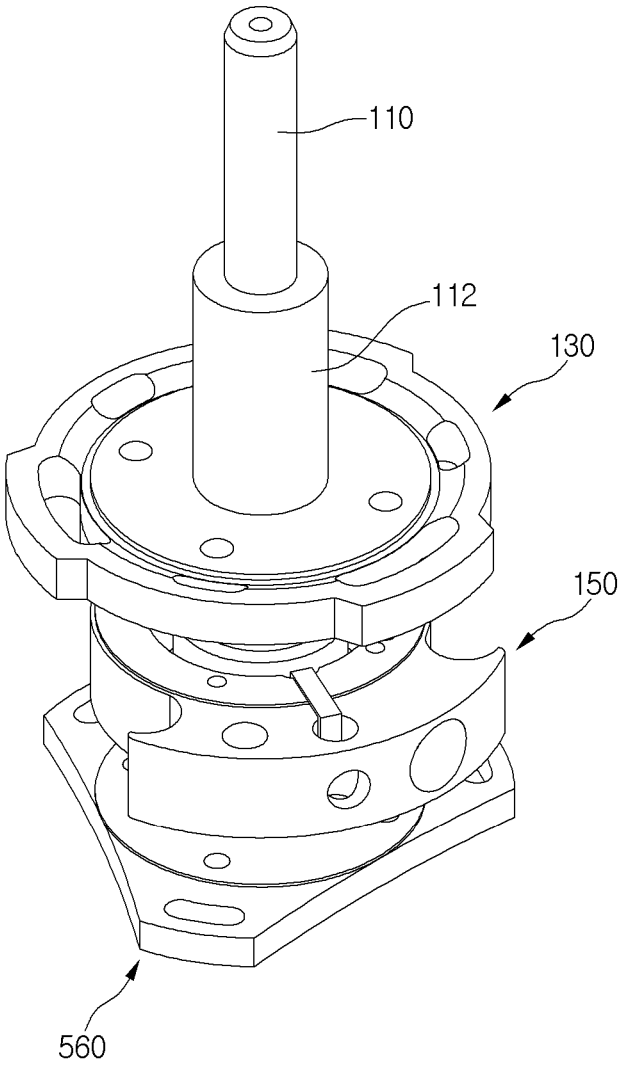
FIG. 18 is an exploded perspective view of the cylinder assembly of FIG. 17.
Figure 19:
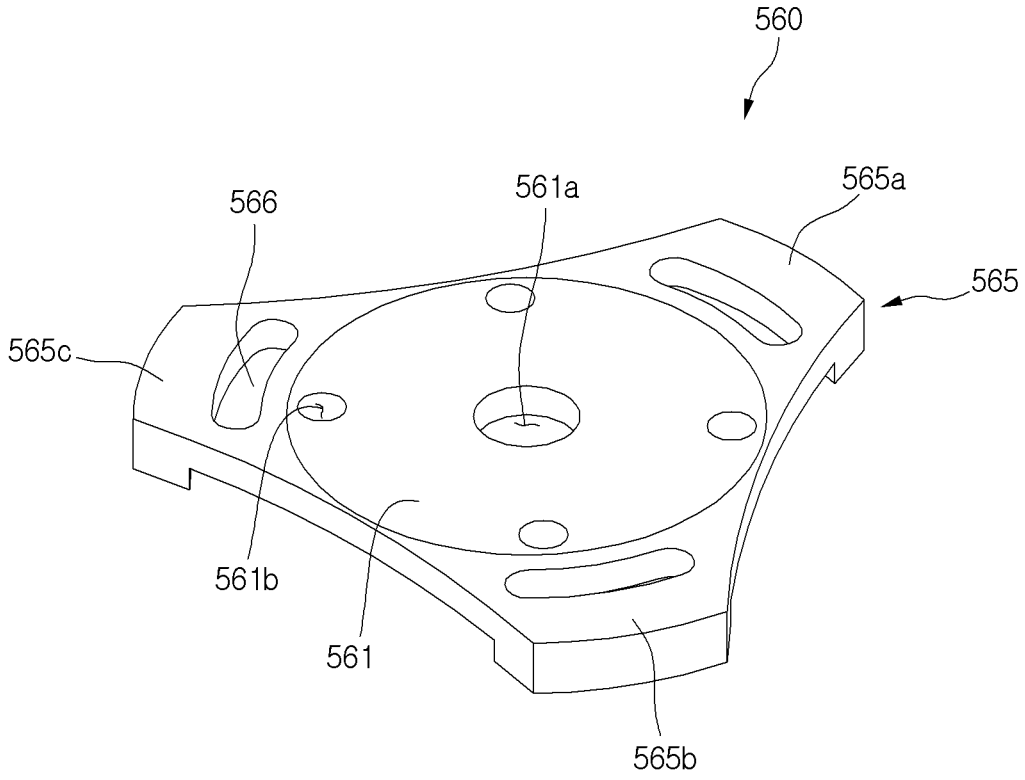
FIG. 19 is a view of a sub bearing according to another embodiment.

FIG. 17 is a perspective view of a cylinder assembly according to another embodiment. FIG. 18 is an exploded perspective view of the cylinder assembly of FIG. 17. FIG. 19 is a view of a sub bearing according to another embodiment.

A portion of components of the compression mechanism 100 according to this embodiment will be described with reference to FIGS. 17 to 19.

The compression mechanism 100 according to this embodiment may include the cylinder 150 that accommodates the roller eccentrically coupled to the rotational shaft 110 to rotate according to the predetermined rotational radius and defining the suction chamber and compression chamber of the refrigerant, the main bearing 130 coupled to the upper portion of the cylinder 130, and a sub bearing 560 coupled to the lower portion of the cylinder 150. The shaft housing 112 may surround at least a portion of the rotational shaft 110 and be disposed on the upper portion of the main bearing 130. The shaft housing 112 may extend in the upward direction from the top surface of the main bearing 130.

The main bearing 130 may be designed in shape or dimension to withstand load or vibration applied to the compression mechanism 100 due to a motor electromagnetic force or a refrigerant gas discharge force generated while the compressor operates and prevent the compression mechanism 100 from being deformed while the compression mechanism 100 is inserted into the case 180. As the components of the main bearing 130 are the same as those of the main bearing described with reference to FIGS. 12 and 13, detailed descriptions thereof have been omitted.

In this embodiment, the sub bearing 560 may be press-fitted to the inner circumferential surface of the case 180, in addition to the main bearing 130. In detail, referring to FIG. 19, the sub bearing 560 according to this embodiment may include a main body 561 having an approximately disc shape and at least one press-fit portion 565 that extends outward from the main body 561 in a radial direction and press-fitted to the case 180. The press-fit portion 565 may be referred as a "sub press-fit portion".

For example, the press-fit portion 565 may include a plurality of press-fit portions 565*a*, 565*b*, and 565*c*. The plurality of press-fit portions 565*a*, 565*b*, and 565*c* may include a first press-fit portion 565*a*, a second press-fit portion 535*b*, and a third press-fit portion 565*c*.

A shaft coupling portion 561*a*, into which the rotational shaft 110 may be inserted, may be defined in an approximately central portion of the main body 561. The rotational shaft 110 may pass through the shaft coupling portion 561*a*. A plurality of coupling holes 561*b* are defined along a circumference of the main body 561. The plurality of coupling holes 561*b* may be defined to surround an outside of the shaft coupling portion 561*a* and be coupled to the cylinder 150 by predetermined coupling members.

Each of the plurality of press-fit portions 565*a*, 565*b*, and 565*c* may be a portion that extends from the main body 561 so as to couple the sub bearing 560 to the case 180. A press-fit surface may be defined on an end of each of the plurality of press-fit portions 565*a*, 565*b*, and 565*c*.

The sub bearing 560 may include a deformation prevention portion 566 to prevent the sub bearing 560 from being deformed due to a force applied to the sub bearing 560 while the rotary compressor operates. The deformation prevention portion 566 may be defined to vertically pass through at least a portion of the sub bearing 560.

The deformation prevention portion 566 may be defined at an inside of the press-fit portion 565 in a radial direction. For example, when a plurality of the press-fit portion 565 is provided, the deformation prevention portion 566 may be defined at the inside of each of the plurality of press-fit portions 565*a*, 565*b*, and 565*c* in the radial direction. In other words, the deformation prevention portion 566 may have a cut shape defined between an outer circumferential surface of the main body 561 and the plurality of press-fit portions 565*a*, 565*b*, and 565*c*.

As the deformation prevention portion 566 is vertically defined in the sub bearing 560 to provide a space in which a compressed discharge gas or oil may flow, the deformation prevention portion 566 may be referred to as an "oil hole". As the deformation prevention portion 566 is defined to provide a space in which the sub bearing 560 may be deformed, that is, a space in which deformation may be buffered, the compression mechanism 100 may be reduced in deformation while the rotary compressor operates.

Figure 20:
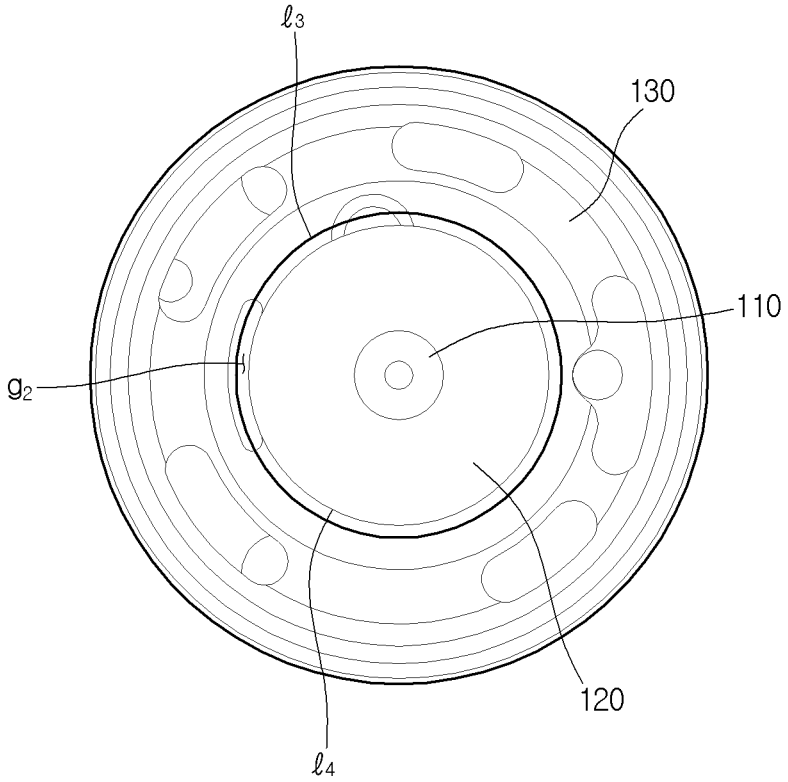
FIG. 20 is a view illustrating of a uniform air gap of the compression mechanism according to an embodiment.
Figure 21:
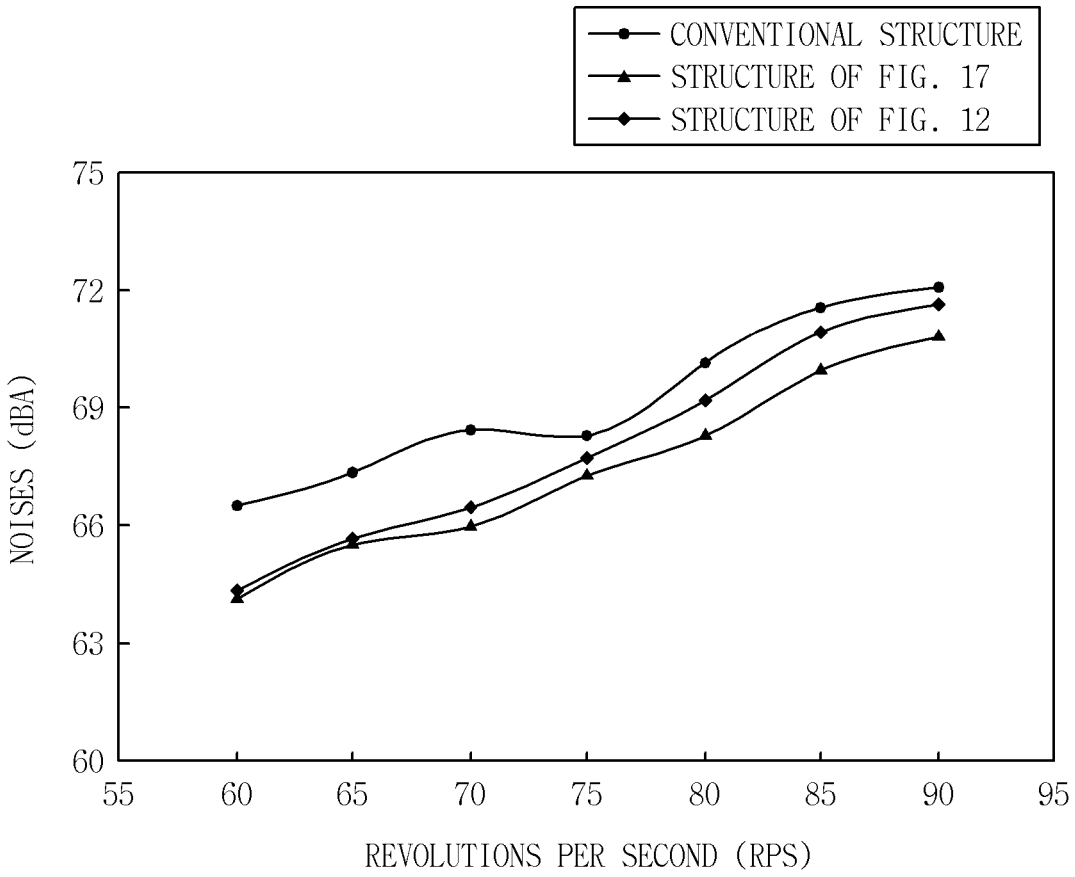
FIG. 21 is a graph showing a noise reduction effect of the rotary compressor according to an embodiment.

FIG. 20 is a view illustrating of a uniform air gap of the compression mechanism according to an embodiment. FIG. 21 is a graph showing a noise reduction effect of the rotary compressor according to an embodiment.

In the rotary compressor according to an embodiment, as the compression mechanism is press-fitted and coupled to the inner circumferential surface of the case, it is unnecessary to perform welding as in the related art, thereby simplifying a manufacturing process of the compressor without causing leakage of the refrigerant.

Figure 4:
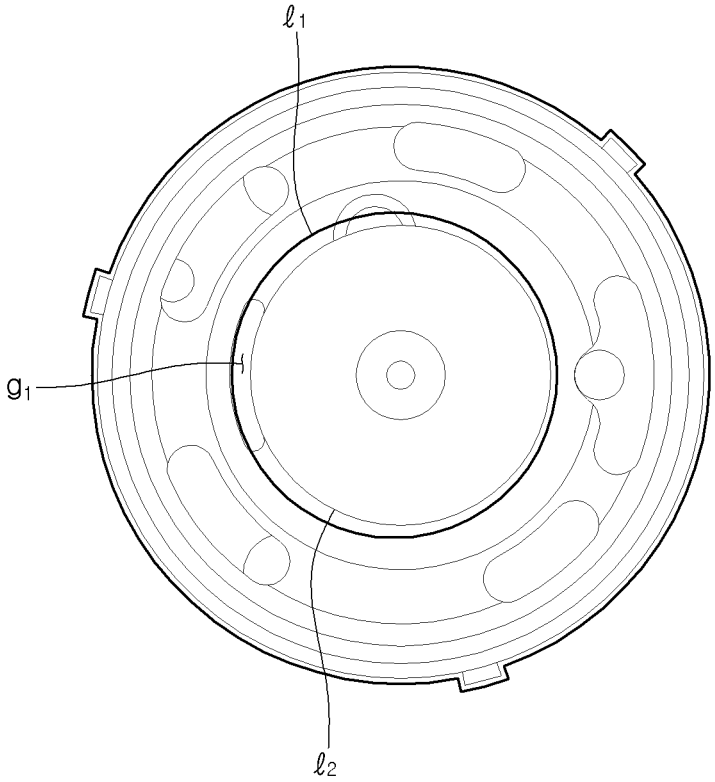
FIG. 4 is a view illustrating a state in which an air gap g1 is non-uniform in the related art rotary compressor of FIG. 1.

Also, generation of noise due to non-uniform air gaps caused by the power imbalance between the plurality of welding portions (see reference symbol W1 of FIG. 4) like the related art may be prevented. That is, as illustrated in FIG. 20, an air gap g2 may be uniformly defined between an inner circumferential surface $l_3$ of the stator 125 and an outer circumferential surface $l_4$ of the rotor 120 to reduce noises.

FIG. 21 is a graph showing variation is noise generated according to the rotation number or revolutions per second (RPS) while the rotary compressor operates. In detail, FIG. 21 is a graph of results obtained by comparing variations in noise generated according to rotation number or revolutions per second (RPS) in the related art (the welding portion is provided), the press-fit structure of the main bearing of FIG. 12, and the press-fit structure of the main and sub bearings of FIG. 17.

As illustrated in FIG. 21, it is noted that when the structure according to embodiments is adapted, noise is generated less than that generated when the structure according to the related art is adopted. Also, in the embodiments, noise may be generated less in the structure in which the main and sub bearings are both press-fitted when compared to the structure in which only the main bearing is press-fitted.

Figure 22:
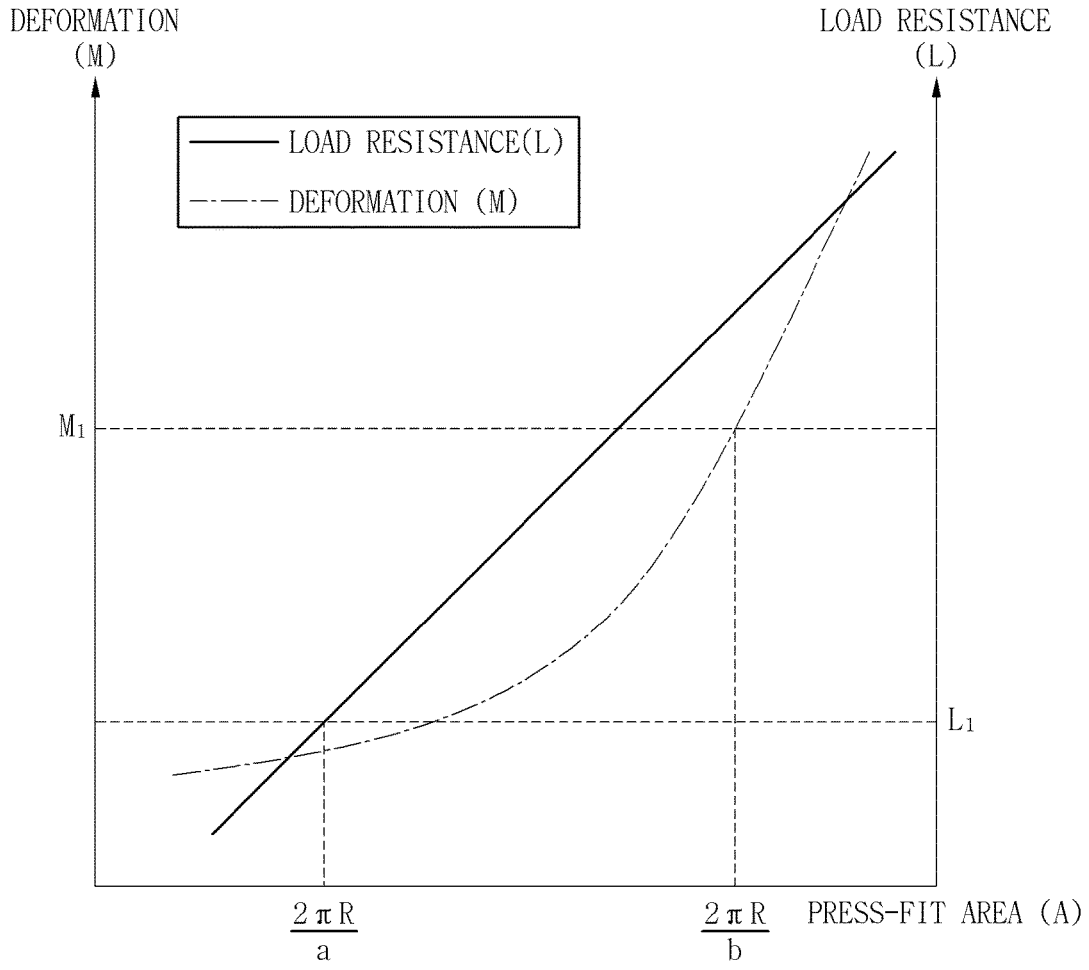
FIG. 22 is a graph showing a proposed design dimension with respect to a contact area of the main bearing according to an embodiment.

FIG. 22 is a graph showing a proposed design dimension with respect to a contact area of the main bearing according to an embodiment. As described above, when the structure of the main bearing of FIGS. 14 and 16 is adopted, a portion of the entire outer circumferential surface of the main bearing is press-fitted to the case 180. An area of the portion of the outer circumferential surface may be referred as as a "press-fit area".

When the press-fit area increases, a degree of load resistance or moment generated by the electric mechanism, that is, the motor, or by the compression mechanism, while the compressor operates may increase. However, the compression mechanism or the case may increase in deformation. Thus, in this graph, the main bearing may be controlled in press-fit area A so that deformation of the compression mechanism or the case is generated less even though supporting a relatively large amount of load (force) generated by the compressor.

Referring to FIG. 22, as described above, when the main bearing increases in press-fit area A, it is seen that each of load resistance L and deformation M increases by a predetermined ratio.

A ratio A1 of the press-fit area to an area of the entire outer circumferential surface of the main bearing is proposed so that the deformation M is relatively low even though the load resistance L is high.

$$2\pi R/a \leq A1 \leq 2\pi R/b$$

A1: Press-fit area ratio

R: Main bearing radius (R), See FIG. 15 a: Maximum contact angle (unit: rad)

b: Minimum contact angle (unit: rad)

Here, the maximum contact angle a represents the maximum angle formed from the central portion $C_1$ of the main bearing to both ends of the press-fit portion. Also, the minimum contact angle b represents the minimum angle formed from the central portion $C_1$ of the main bearing to both ends of the press-fit portion. As described above, the press-fit portion may be determined in dimension so that the press-fit area is defined in a predetermined range to increase the load resistance L and reduce the deformation M.

According to embodiments, as the heated case is thermally inserted in the state in which the main bearing is assembled with the stator, the process for manufacturing the compressor may be simplified. That is, as the jig is provided to install or assemble the compression mechanism and the stator, the compression mechanism may be inserted into the case at a time and in the state in which the compression mechanism and the stator are disposed on the jig. Thus, the process for manufacturing the compressor may be simplified, and accordingly, the compressor may be reduced in manufacturing cost.

Also, as the compression mechanism is assembled with the case in the press-fitting manner, limitations due to conventional welding may be prevented. That is, refrigerant leakage due to defective welding and increase in noise generated due to non-uniform air gaps caused by the force acting on the plurality of welding portions may be prevented.

Also, as a portion of the outer circumferential surface of the main bearing instead of the entire outer circumferential surface of the main bearing is press-fitted to the inner circumferential surface of the case, load or moment generated by the compression mechanism while the compressor operates may be easily transmitted to the case. Also, deformation of the compression mechanism due to the press-fitting may be prevented.

Also, as the sub bearing is press-fitted to the case in addition to the main bearing, the compression mechanism may be easily fixed to the case. Thus, the force transmitted from the main and sub bearings may be uniformly dispersed to the case. Also, deformation of the compression mechanism may be prevented while the compression mechanism is press-fitted.

Embodiments disclosed herein provide a rotary compressor capable of simplifying a process for manufacturing the compressor and reducing noise.

Embodiments disclosed herein provide a rotary compressor that may include a case having an inner space; a stator to which power may be applied, the stator being disposed in the case; and a compression mechanism disposed on or adjacent one side of the stator to generate a compression force of a refrigerant. The compression mechanism may include a rotational shaft, which may be rotatable; a cylinder that accommodates a roller coupled to the rotational shaft; a main bearing coupled to one or a first side of the cylinder; and a sub bearing coupled to the other or a second side of the cylinder. The main bearing may be press-fitted and fixed to an inner surface of the case.

The main bearing may include a bearing body having a shaft through hole, through which the rotational shaft may pass; and at least one press-fit part or portion that defines at least a portion of an outer circumferential surface of the main bearing, the at least one press-fit part being press-fitted to the inner circumferential surface of the case. The press-fit part may be inserted into an inner space of the case in a state in which the case is heated.

The main bearing may further include a non-contact part or portion that defines the other portion of the outer circumferential surface of the main bearing and spaced apart from the inner circumferential surface of the case. The bearing body may include a valve installation part or portion having a recessed shape to allow a discharge valve to be seated thereon and in which a discharge hole, through which a compressed refrigerant may be discharged, may be defined. A virtual line that passes from a center of the main bearing to the discharge hole may contact the non-contact part.

The discharge valve may include a valve body that selectively covers the discharge hole, and a coupling part or portion that allows the valve body to be coupled to the valve body. The non-contact part may have a length ($L_2$) that is longer than a length ($L_1$) of a line that connects the discharge hole to the coupling part.

The main bearing may further include a deformation prevention part or portion that vertically passes through the main bearing to prevent the main bearing from being deformed while the main bearing is press-fitted. An angle ($\alpha_2$) formed by lines that connect a central portion ($C_1$) of the main bearing to both ends of the deformation prevention part may be greater than an angle ($\alpha_1$) formed by lines that connect the central portion ($C_1$) of the main bearing to the discharge hole and the coupling part.

The sub bearing may include a sub press-fit part or portion that is press-fitted and fixed to the inner circumferential surface of the case. The press-fit part of the main bearing may be provided in plurality spaced apart from each other, and the non-contact part may be defined between one press-fit part and the other press-fit part.

Embodiments disclosed herein further provide a method of manufacturing a rotary compressor that may include installing a compression mechanism including a cylinder and a main bearing on a jig; disposing a stator on or at one side of the compression mechanism to install the stator on the jig; heating a case; inserting the compression mechanism and the stator into the heated case; and press-fitting the main bearing to an inner surface of the case. The installing of the compression mechanism on the jig may include defining a refrigerant suction hole of the cylinder to face a suction pipe aligning part or portion defined in the jig. The disposing of the stator at the one side of the compression mechanism to install the stator on the jig may include seating an outer circumferential part or portion of the stator on a support surface defined on the jig.

The method may further include assembling a suction pipe with a connection pipe disposed in the case. The connection pipe may be seated on the suction pipe aligning part of the jig.

Embodiments disclosed herein further provide an apparatus for manufacturing a rotary compressor including a stator, a compression mechanism, and a case. The apparatus may include a seating part or seat, on which the compression mechanism may be seated; a stator support part or support that extends upward from the seating part to support the stator; and a guide device or guide disposed at one side of the seating part to guide a position of a connection pipe disposed in the case.

The stator support part may be provided in plurality, and a placing part or portion, on which a press-fit part or portion of the main bearing disposed in the compression mechanism may be placed, may be defined between the plurality of stator support parts. A support surface, on which an outer circumferential part or portion of the stator may be placed, may be defined on a top surface of the stator support part.

The guide device may include a guide body, and a suction pipe aligning part or portion recessed downward from the guide body to allow the connection pipe to be seated thereon.

The details of one or more embodiments are set forth in the accompanying drawings and the description below. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a case having an inner space;

a stator to which power is applied, the stator being disposed in the case; and a compression mechanism disposed adjacent the stator to generate a compression force of a refrigerant, wherein the compression mechanism comprises:

a rotational shaft;

a cylinder that accommodates a roller coupled to the rotational shaft;

a main bearing coupled to a first side of the cylinder, the main bearing being press-fitted and fixed to an inner circumferential surface of the case; and a sub bearing coupled to a second side of the cylinder, wherein the main bearing comprises:

a bearing body having a shaft through hole through which the rotational shaft passes, the bearing body comprising a valve installation portion having a recessed shape to allow a discharge valve to be seated thereon and in which a discharge hole, through which a compressed refrigerant is discharged, is defined; and first and second deformation prevention portions that vertically pass through the main bearing to prevent the main bearing from being deformed while the main bearing is press-fitted, wherein the discharge valve comprises a valve body that selectively covers the discharge hole and a coupling portion that couples the valve body to the valve installation portion, and wherein a sum of a first angle formed by a first pair of lines that connects a center of the main bearing to both ends of the first deformation prevention portion and a second angle formed by a second pair of lines that connects the center of the main bearing to both ends of the second deformation prevention portion is greater than an angle formed by lines that connect the center of the main bearing to the discharge hole and the coupling portion.

2. The rotary compressor according to claim 1, wherein the main bearing further comprises:

at least one press-fit portion that defines at least a first portion of an outer circumferential surface of the main bearing, the at least one press-fit portion being press-fitted to the inner circumferential surface of the case.

3. The rotary compressor according to claim 2, wherein the main bearing further comprises at least one non-contact portion that defines a second portion of the outer circumferential surface of the main bearing and spaced apart from the inner circumferential surface of the case.

4. The rotary compressor according to claim 1, wherein a virtual line that passes from the center of the main bearing to a center of the discharge hole contacts the at least one non-contact portion.

5. The rotary compressor according to claim 3, wherein the at least one non-contact portion has a length longer than a length of a line that connects the a center of the discharge hole to a center of the coupling portion.

6. The rotary compressor according to claim 2, wherein the at least one press-fit portion comprises a plurality of the press-fit portions provided spaced apart from each other, and wherein a non-contact portion is defined between adjacent press-fit portions.

7. The rotary compressor according to claim 1, wherein the sub bearing comprises at least one sub press-fit portion which is press-fitted and fixed to the inner circumferential surface of the case.

8. The rotary compressor according to claim 1, wherein the first deformation prevention portion has a size greater than a size of the valve installation portion.

9. The rotary compressor according to claim 1, wherein the second deformation prevention portion has a size greater than a size of the valve installation portion.

10. The rotary compressor according to claim 2, wherein the first deformation prevention portion is defined inside the at least one press-fit portion in a radial direction.

11. The rotary compressor according to claim 10, wherein the main bearing further comprises at least two press-fit portions that define at least a first portion of an outer circumferential surface of the main bearing, the at least two press-fit portions being press-fitted to the inner circumferential surface of the case, and wherein the second deformation prevention portion is defined inside of one of the at least two press-fit portions in a radial direction.

12. The rotary compressor according to claim 1, wherein the valve installation portion has a depth less than a predetermined depth to prevent the discharge of the compressed refrigerant from being restricted.

* * * * *